US005106045A

United States Patent [19]

Bezotte

[11] Patent Number: 5,106,045

[45] Date of Patent: Apr. 21, 1992

[54] LADDER CADDY APPARATUS

[76] Inventor: Jack E. Bezotte, P.O. Box 316, Grand Marais, Mich. 49839

[21] Appl. No.: 732,609

[22] Filed: Jul. 19, 1991

[51] Int. Cl.[5] ..... E06C 7/14

[52] U.S. Cl. ..... 248/210; 182/129

[58] Field of Search ..... 182/129; 248/210, 211, 248/238

[56] References Cited

U.S. PATENT DOCUMENTS

| | | | |
|---|---|---|---|
| 2,367,256 | 1/1945 | Atkins | 248/210 |
| 3,131,900 | 5/1964 | Anderson | 248/210 |
| 3,182,943 | 5/1965 | Crossman | 248/210 |
| 3,246,867 | 4/1966 | Ewing | 248/210 |
| 4,476,984 | 10/1984 | Garrett | 248/210 |

*Primary Examiner*—Reinaldo P. Machado
*Attorney, Agent, or Firm*—Leon Gilden

[57] ABSTRACT

A clamp member is mounted to a leg of a ladder assembly, wherein the clamp member includes a channel to receive a leg therewithin for adjustably mounting the clamp member as desired relative to the associated ladder leg. A paint support bracket is provided formed with a suspension web mounting a support cylinder at a lower terminal end for mounting a paint can therewithin. The suspension web includes a keyhole slot positioned adjacent an upper terminal end thereof for pivotally mounting the suspension web relative to the clamp member.

6 Claims, 6 Drawing Sheets

LADDER CADDY APPARATUS

BACKGROUND OF THE INVENTION

1. Field of the Invention

The field of invention relates to ladder apparatus, and more particularly pertains to a new and improved ladder caddy apparatus wherein the same is arranged for pivotally mounting a paint container relative to a ladder for ease of access to the paint container during use.

2. Description of the Prior Art

Various apparatus is utilized in the prior art to permit an individual to support a container of paint relative to a ladder. Prior art structure has not been entirely satisfactory to effect this result due to elaborate construction of the prior art or limited pivotal mounting of the structure relative to an associated ladder to accommodate various orientation of the ladder relative to a support wall. Examples of the prior art include U.S. Pat. No. 4,776,550 to Storey wherein a paint bucket holder is pivotally mounted to a ladder utilizing notches on an indexing plate permitting relative rotation of the plate to a clamp structure for the ladder apparatus.

U.S. Pat. No. 4,036,463 to Hopkins sets forth a paint can and brush receptacle wherein a bracket structure for the paint can and brush receptacle is slidably received within a notched support bracket fixedly mounted to a ladder leg.

U.S. Pat. No. 4,702,446 to Brown sets forth a ladder and caddy structure directed through a hollow rung of an associated metallic ladder.

U.S. Pat. No. 4,580,752 to Patrick sets forth a hook member mounted to a ladder rung, with a lower tether line secured to an associated paint bucket limiting and minimizing sway of the bucket relative to the ladder structure.

U.S. Pat. No. 4,560,127 to Ippolito sets forth a paint caddy structure wherein a bracket member is pivotally mounted to a clamp structure secured to a ladder rail.

As such, it may be appreciated that there continues to be a need for a new and improved ladder caddy apparatus as set forth by the instant invention which addresses both the problems of ease of use as well as effectiveness of construction and in this respect, the present invention substantially fulfills this need.

SUMMARY OF THE INVENTION

In view of the foregoing disadvantages inherent in the known types of ladder accessory apparatus now present in the prior art, the present invention provides a ladder caddy apparatus wherein the same pivotally mounts a single or plurality of paint containers and the like relative to a ladder leg of an associated ladder structure. As such, the general purpose of the present invention, which will be described subsequently in greater detail, is to provide a new and improved ladder caddy apparatus which has all the advantages of the prior art ladder accessory apparatus and none of the disadvantages.

To attain this, the present invention provides a clamp member mounted to a leg of a ladder assembly, wherein the clamp member includes a channel to receive a leg therewithin for adjustably mounting the clamp member as desired relative to the associated ladder leg. A paint support bracket is provided formed with a suspension web mounting a support cylinder at a lower terminal end for mounting a paint can therewithin. The suspension web includes a keyhole slot positioned adjacent an upper terminal end thereof for pivotally mounting the suspension web relative to the clamp member.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better apperciated. There are, of course, additional features of the invention that will be described hereinafter and which will form the subject matter of the claims appended hereto. Those skilled in the art will appreciate that the conception, upon which this disclosure is based, may readily be utilized as a basic for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved ladder caddy apparatus which has all the advantages of the prior art ladder accessory apparatus and none of the disadvantages.

It is another object of the present invention to provide a new and improved ladder caddy apparatus which may be easily and efficiently manufactured and marketed.

It is a further object of the present invention to provide a new and improved ladder caddy apparatus which is of a durable and reliable construction.

An even further object of the present invention is to provide a new and improved ladder caddy apparatus which is susceptible of a low cost of manufacture with regard to both materials and labor, and which accordingly is then susceptible of low prices of sale to the consuming public, thereby making such ladder caddy apparatus economically available to the buying public.

Still yet another object of the present invention is to provide a new and improved ladder caddy apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
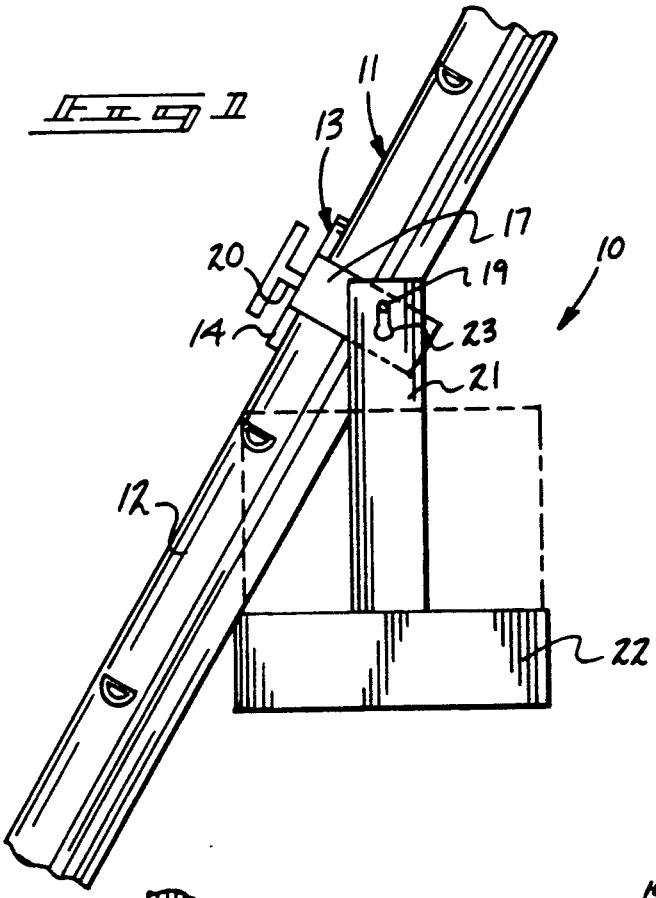
FIG. 1 is an orthographic frontal view, taken in elevation of the apparatus, mounted to a ladder structure.

With reference now to the drawings, and in particular to FIGS. 1 to 9 thereof, a new and improved ladder caddy apparatus embodying the principles and concepts of the present invention and generally designated by the reference numeral 10 will be described.

Figure 1A:
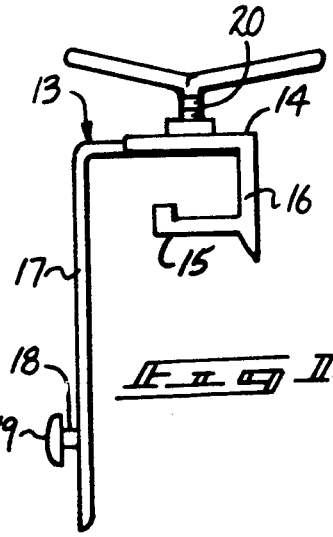
FIG. 1*a* is an orthographic side view of the clamp structure utilized by the invention.
Figure 2:
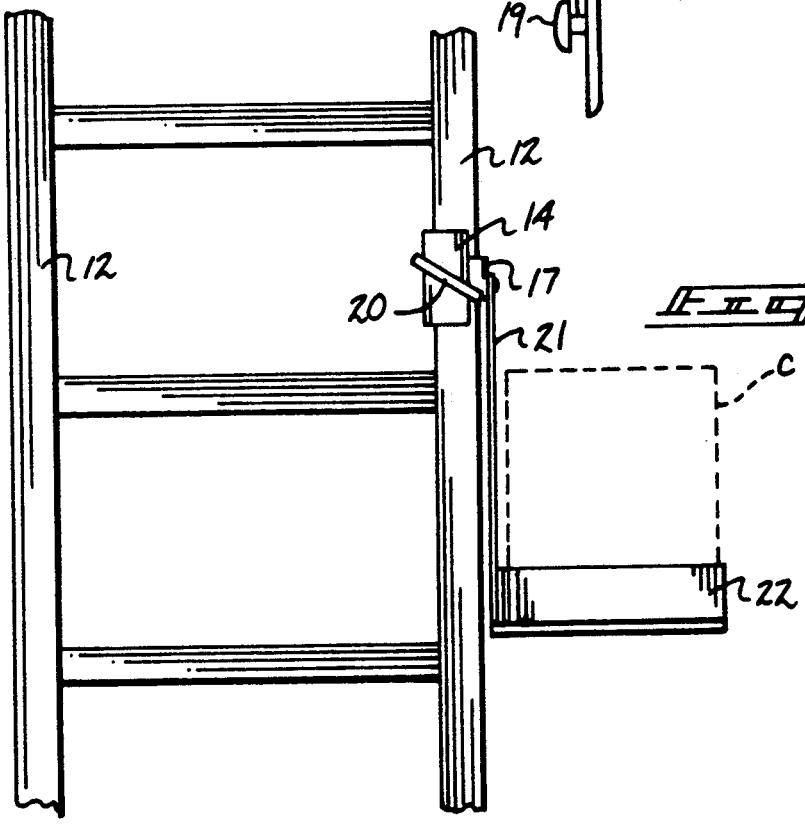
FIG. 2 is an orthographic side view of the apparatus as set forth in FIG. 1.
Figure 3:
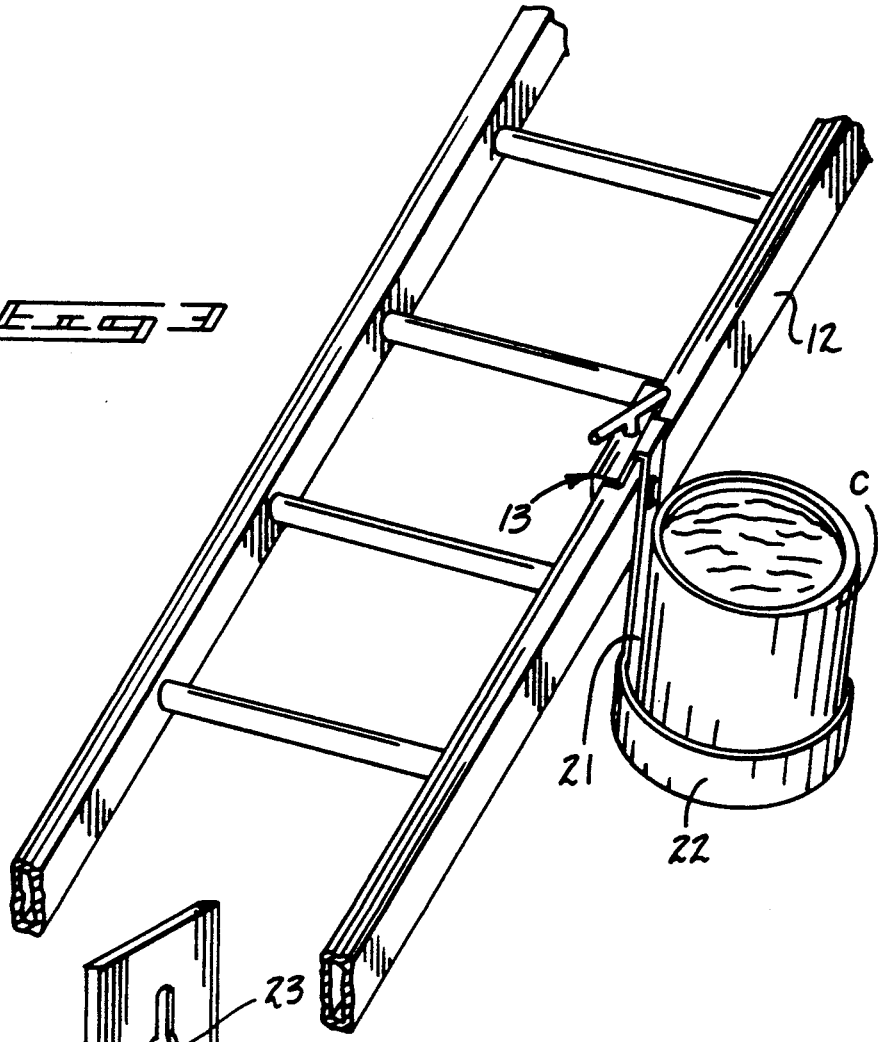
FIG. 3 is an isometric illustration of the apparatus mounted to a ladder structure.

More specifically, the ladder caddy apparatus 10 of the instant invention essentially comprises a ladder assembly 11 defined by spaced parallel ladder legs 12 mounting ladder rungs orthogonally therebetween at spaced intervals between the ladder legs. A ladder leg clamp 13 is provided (see FIG. 1*a*) including a top plate 14 spaced from and parallel a bottom plate 15. A connecting web 16 is orthogonally mounted between rear terminal ends of the top and bottom plates defined at a channel to receive a ladder leg 12 therewithin. A support flange 17 is fixedly mounted to a forward terminal end of the top plate 14 directed downwardly therefrom and orthogonally mounting a support boss 18 to an exterior surface of the support flange 17. The support boss 18 includes an abutment head 19 defined by a first diameter at an outer terminal end thereof. A lock screw 20 is threadedly directed through the top plate 14 to fixedly secure the ladder leg within the channel defined by the top plate, the bottom plate, and connecting web. A paint support bracket, as illustrated in FIG. 3 for example, utilizes a suspension web 21 that includes a support cylinder 22 fixedly and orthogonally mounted to a lower terminal end of the suspension web and tangentially secured to the support cylinder 22. The support cylinder 22 includes a floor 22*a* to receive a paint container "C" therewithin. The suspension web 21 includes a keyhole opening 23 that is defined by a bore with a second diameter greater than the first diameter in communication with a slot projecting above the bore to receive the support boss 18. The slot is defined by a width less than the first diameter to arrest the suspension web between the abutment head and the support flange 17, as illustrated, in a pivotal relationship.

Figure 4:
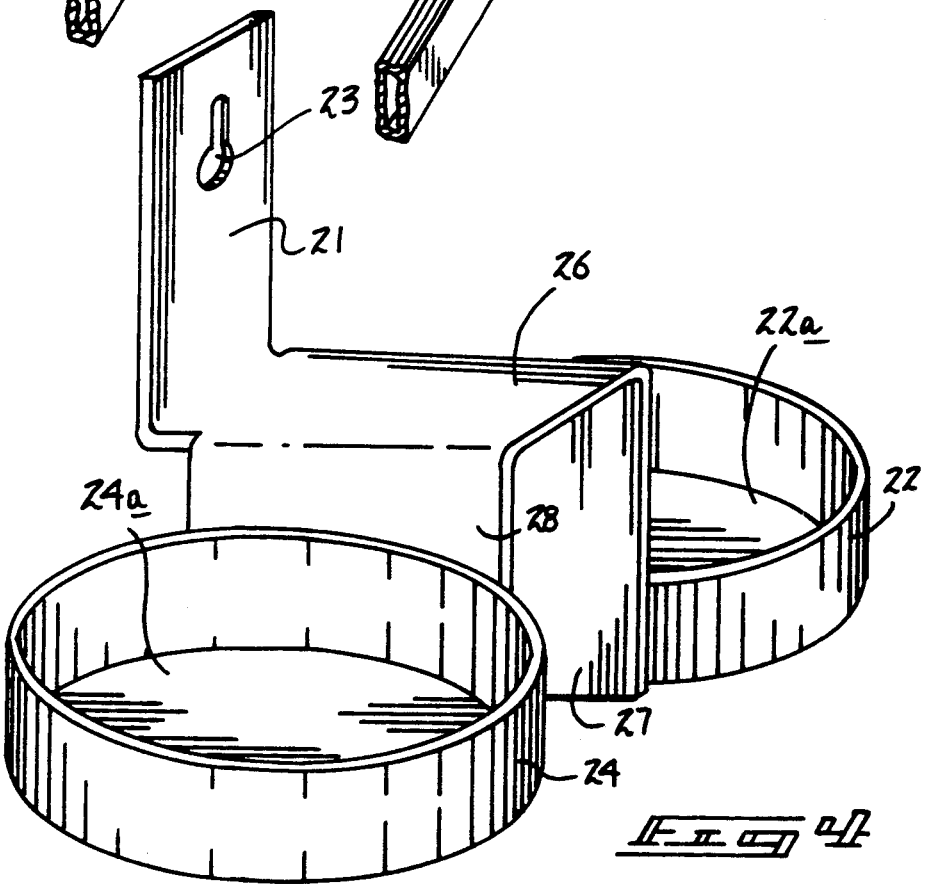
FIG. 4 is an isometric illustration of a modified paint support bracket utilized by the instant invention.

FIG. 4 illustrates a modified paint support bracket structure, wherein a further support cylinder 24 is provided that includes a further floor 24*a*. A projecting plate 26 is orthogonally formed to a lower terminal end of the suspension web 21 that includes first and second legs 27 and 28 respectively directed downwardly from opposed sides of the projecting plate 26 to mount the support cylinder 22 and further support cylinder 24 at lower terminal ends of the respective first and second legs 27 and 28.

Figure 5:
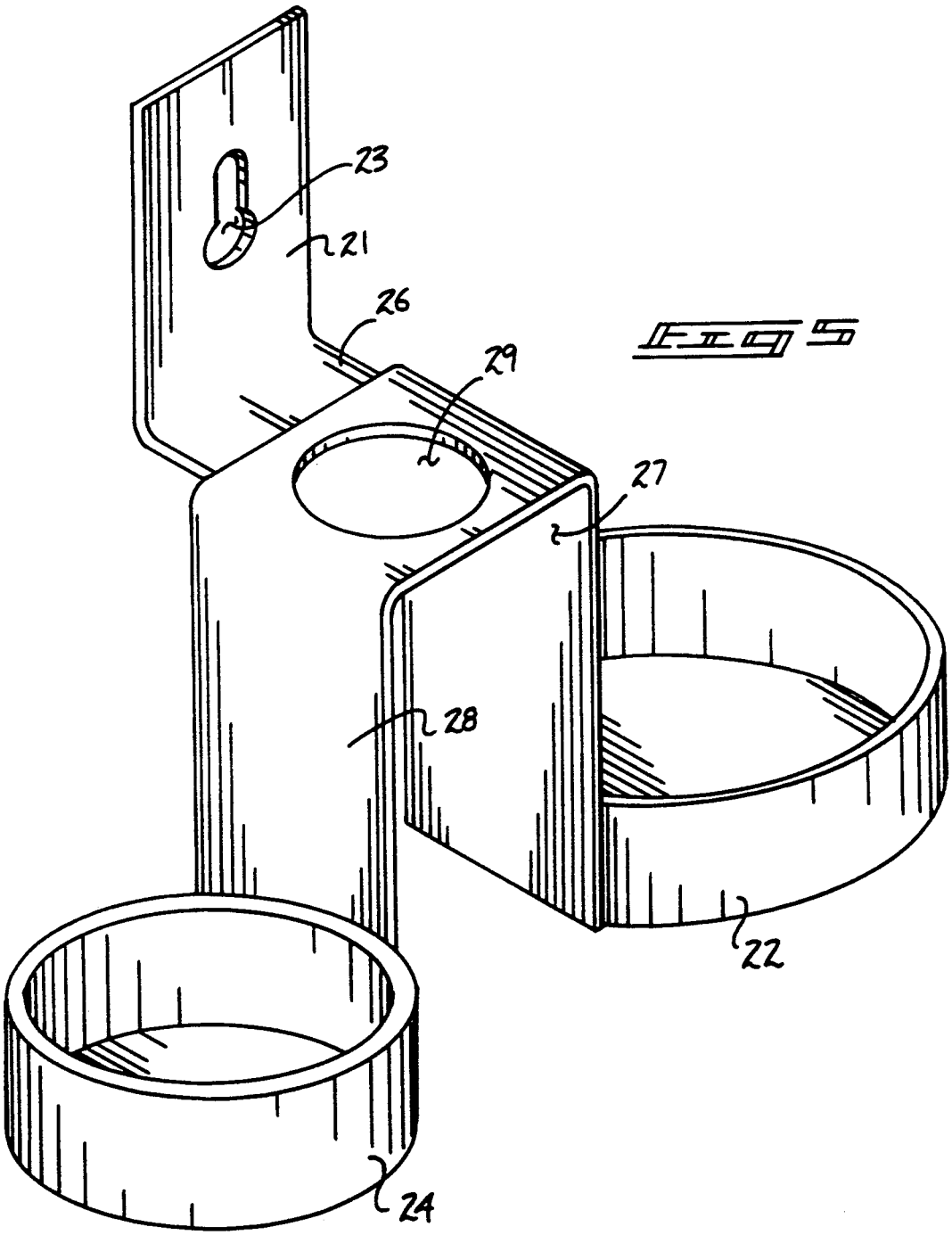
FIG. 5 is an isometric illustration of a further modified paint support bracket as set forth by the instant invention.

The modified paint support bracket, as illustrated in FIG. 5, includes a projecting plate opening 29 orthogonally directly through the projecting plate 26 to accommodate a further paint container for utilization in trim and the like within the projection plate opening 29.

Figure 6:
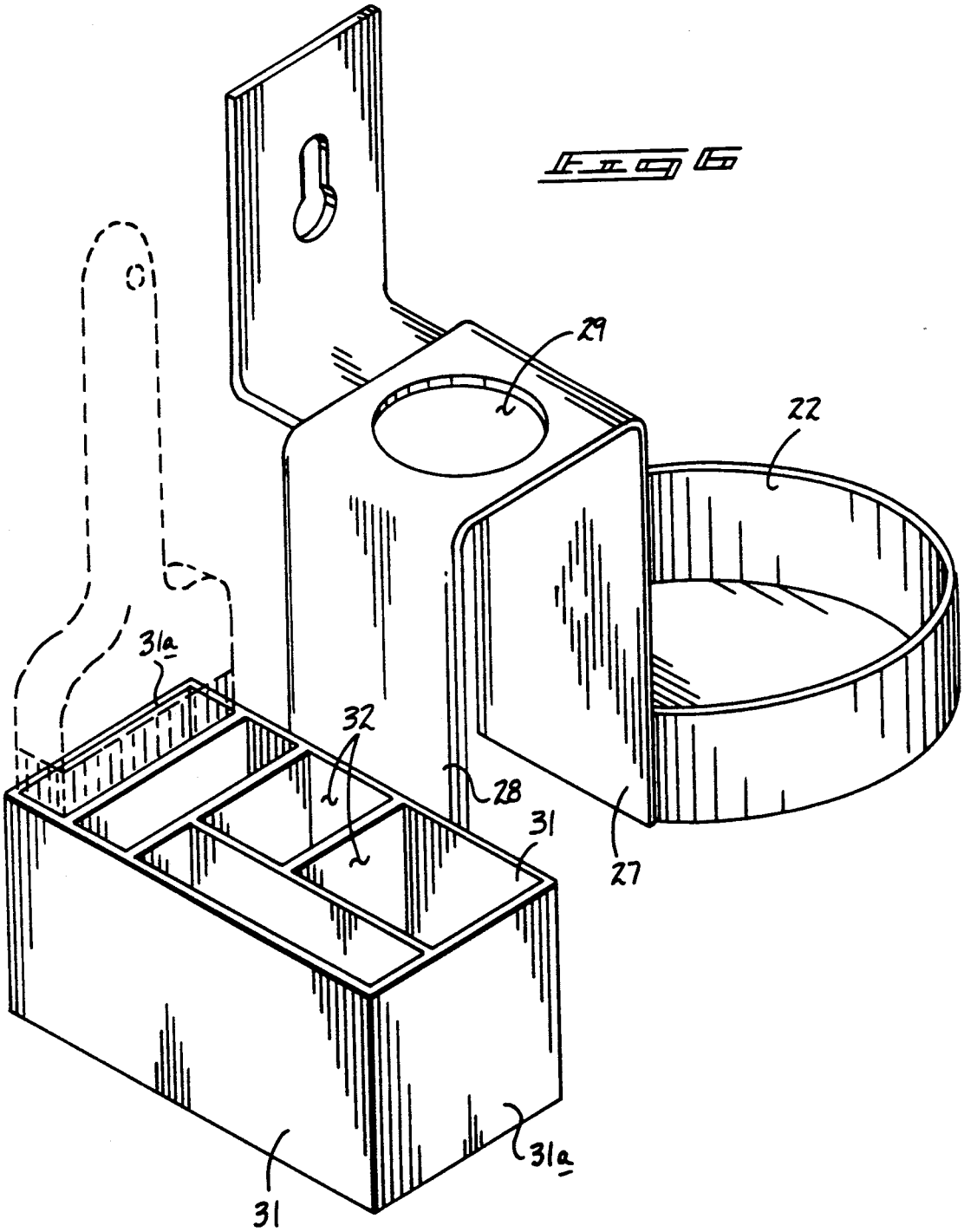
FIG. 6 is an isometric illustration of a yet further modified paint support bracket as set forth by the instant invention.

A support tray, as illustrated in FIG. 6, mounted at a lower terminal end of the second leg 28 defined by parallel side walls 31, parallel end walls 31*a*, defining compartments 32 therewithin.

Figure 7:
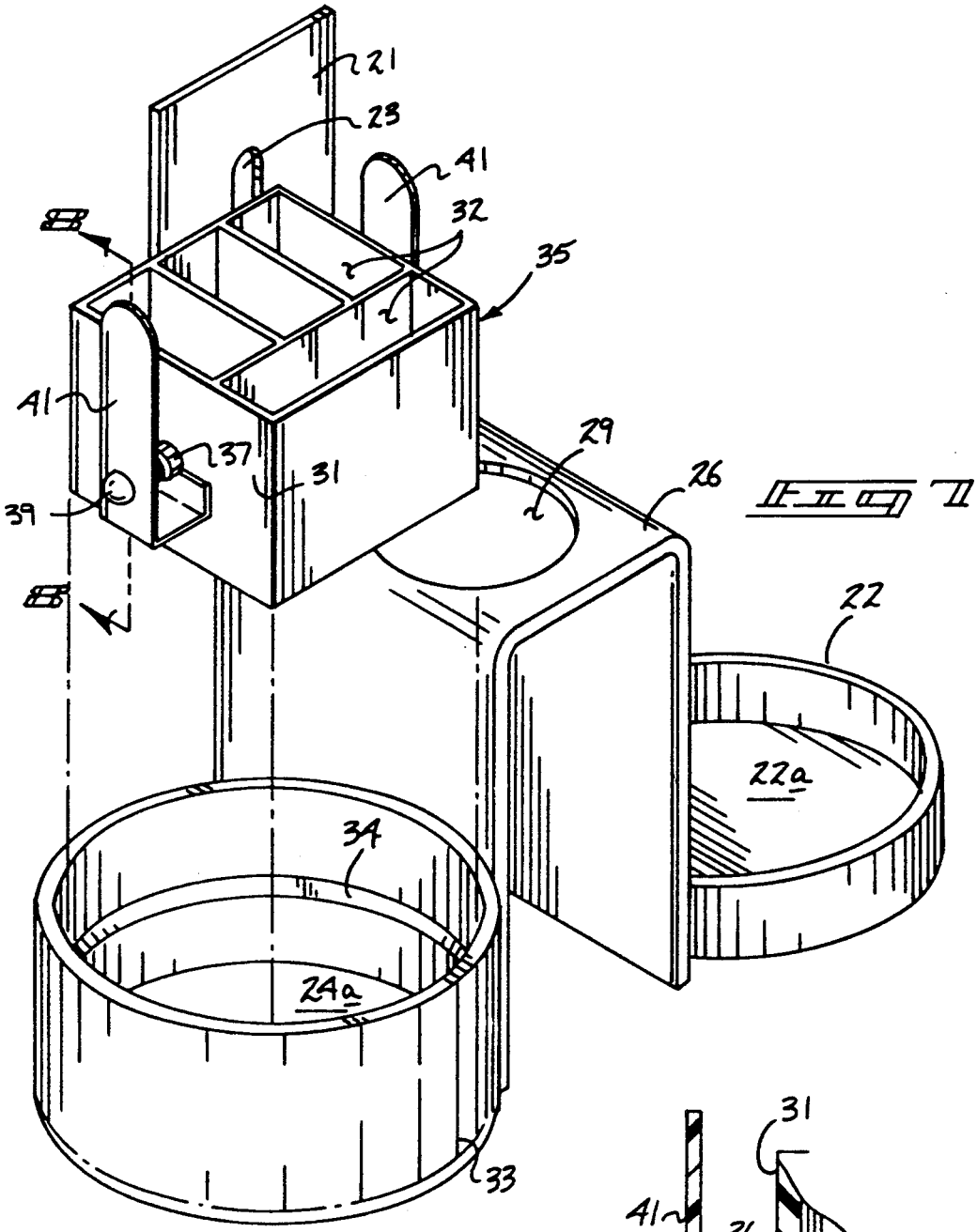
FIG. 7 is an isometric illustration of a still further modified paint support bracket structure utilized by the instant invention.
Figure 8:
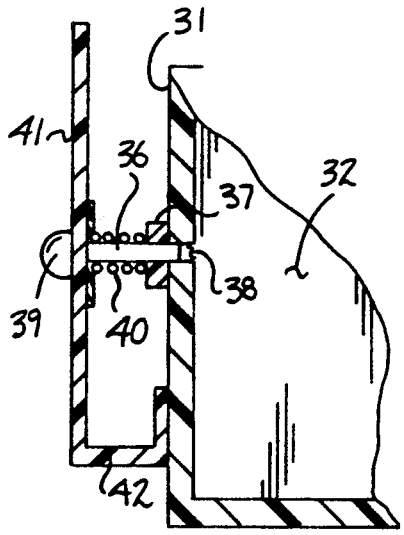
FIG. 8 is an orthographic view, taken along the lines 8—8 of FIG. 7 in the direction indicated by the arrows.
Figure 9:
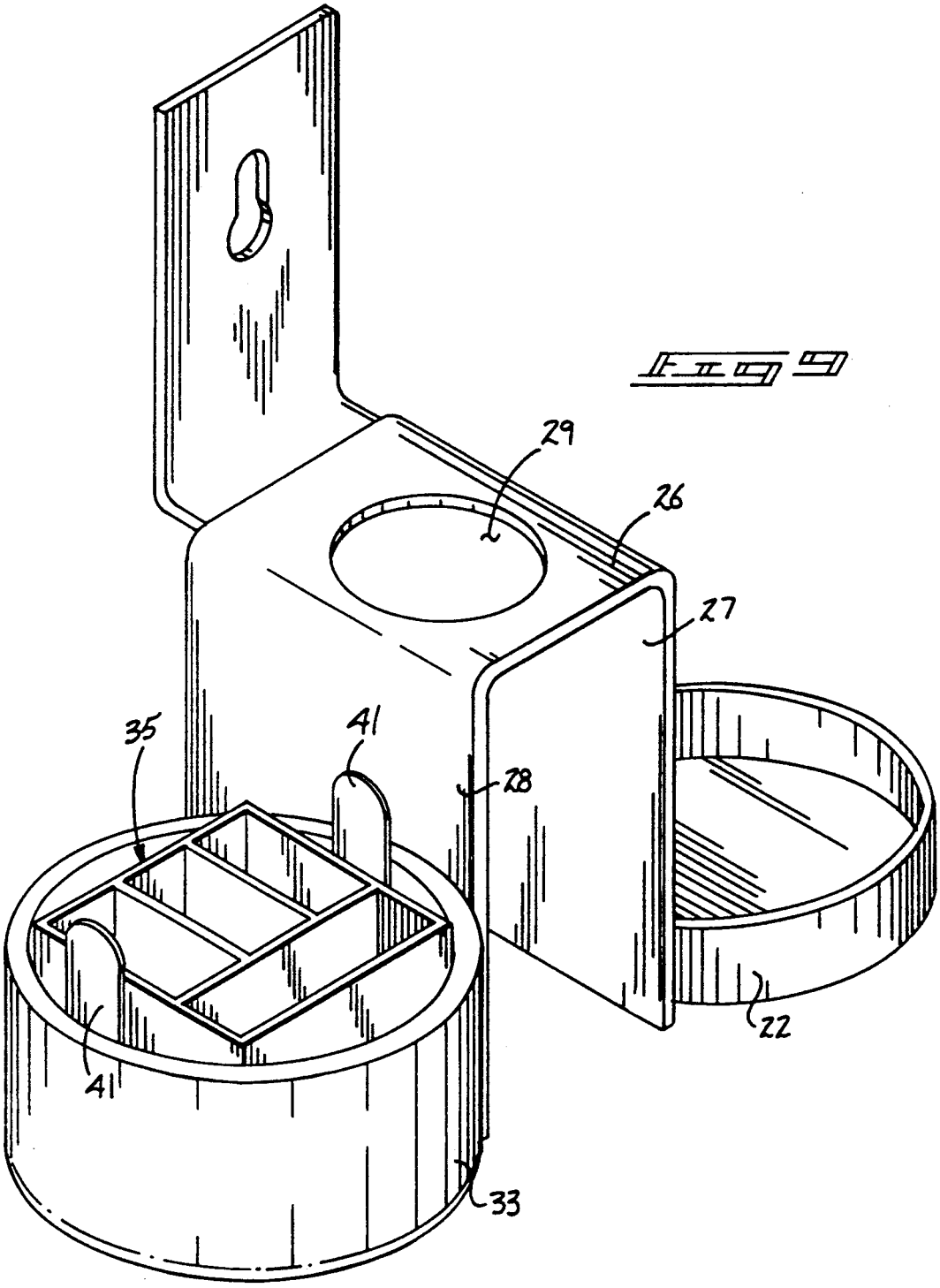
FIG. 9 is an isometric illustration of the paint support bracket structure, as illustrated in FIG. 7, in an assembled configuration.

FIGS. 7–9 illustrate the further modified bracket structure, wherein the respective first and second legs 27 and 28 mount the support cylinder 22 to the lower terminal end of the first leg 27 in tangential relationship, wherein a modified further support cylinder 33 is provided tangentially and fixedly mounted to a lower terminal end of a second leg 28. Further support cylinder 33 includes a support cylinder floor 24*a* and includes a circumferential groove 24 spaced above the floor a predetermined spacing and directed into the interior surface of the further cylinder 33. A modified container 35 is provided, wherein the side walls 31 each include a cylindrical mount 36 spaced above the lower terminal end of the respective wall 31 a spacing equal to the predetermined spacing, including a semicylindrical groove follower 39 fixedly mounted at a forward terminal end of each cylindrical mount 36. A mount support 37 slidably and telescopingly receives the cylindrical mount 36 slidably therethrough in coaxial alignment with a wall bore 38. A spring 40 is captured between a retraction plate 41 fixedly mounted to a forward terminal end of the cylindrical mount 36 to normally bias the follower 39 in a spaced rrelationship relative to the wall 31. The retraction plate 41 is mounted to the wall 31 by a plate mount 42. Upon projection of the support container 35 within the modified further support cylinder 33, the followers 39 are secured rotatably within the groove 34, in a manner as illustrated in FIG. 9. To remove the support cylinder 33 from the further support cylinder 33, the retraction plate members 41 are compressed towards the walls 31 to effect retraction of the followers 39 relative to the groove 34 permitting removal of the support container 35.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A ladder caddy apparatus for securement to a ladder, wherein the ladder includes a plurality of ladder legs mounting ladder rungs at spaced intervals therebetween, wherein the apparatus comprises, a ladder leg clamp, the clamp including a top plate spaced above a bottom plate, with a connecting web fixedly mounting the top plate to the bottom plate defining a channel to receive the ladder leg therewithin, and a lock screw threadedly directed through the top plate into the channel for locking the ladder leg within the channel, and a support flange fixedly and orthogonally mounted to a forward terminal end of the top plate directed downwardly therefrom and below the bottom plate, including a support boss fixedly mounted to the exterior surface of the support flange, the support boss including an abutment head defined by a first diameter formed at an outer terminal end of the support boss, and a support bracket, including a suspension web, the suspension web including a keyhole opening directed through the suspension web adjacent an upper terminal end of the suspension web for receiving the abutment head therethrough, the keyhole opening including a bore defined by a second diameter greater than the first diameter in communication with a slot directed upwardly of the bore and in communication therewith, wherein the slot is defined by a slot width less than the first diameter, and paint can support means fixedly mounted to a lower terminal end of the suspension web for securement of a paint can therewithin.

2. An apparatus as set forth in claim 1 wherein the paint support means includes a projecting plate fixedly and orthogonally mounted to a lower terminal end of the suspension web, the projecting plate including a first leg and a second leg mounted orthogonally and downwardly relative to the projection plate on opposed sides thereof, the first leg tangentially and fixedly mounting a support cylinder thereto, the support cylinder including a support cylinder floor, and the second leg including a further support cylinder fixedly and tangentially mounted to a lower terminal end of the second leg, the further support cylinder including a further support cylinder floor for mounting a further paint can therewithin.

3. An apparatus as set forth in claim 2 wherein the projecting flange includes a plate opening directed through the plate flange for receiving a further paint can therewithin.

4. An apparatus as set forth claim 3 wherein the further support cylinder includes a cylindrical interior wall surface, and a circumferential groove formed within the interior wall surface above the further support cylinder floor a predetermined spacing, and a support container removably mounted within the further support cylinder on the further support cylinder floor, wherein the support container includes spaced parallel side walls and spaced parallel end walls, and defined by compartments within the support container, and including a groove follower mounted to each side wall, wherein each follower is spaced above each side wall lower terminal edge the predetermined spacing, wherein each follower is arranged for reception within the circumferential groove.

5. An apparatus as set forth in claim 4 wherein each follower is of a semi-cylindrical configuration and mounted to a forward terminal end of a cylindrical mount, the cylindrical mount reciprocatably mounted within a mount support, and each mount support of each cylindrical mount coaxially aligned with a wall bore directed through each side wall and spaced above the lower terminal edge of each side wall the predetermined spacing.

6. An apparatus as set forth in claim 5 wherein each cylindrical mount includes a retraction plate orthogonally mounted to each cylindrical mount at a forward terminal end of the cylindrical mount between the follower and the side wall, and a spring member captured between each retraction plate and each mount support, and each retraction plate including a retraction plate mount fixedly mounting each lower terminal end of each retraction plate to each respective side wall below each respective cylindrical mount and above each lower terminal end of each respective side wall.

* * * * *